US007621592B1

(12) United States Patent
Flannery

(10) Patent No.: US 7,621,592 B1
(45) Date of Patent: Nov. 24, 2009

(54) ROCKER AND HOOK ON HIGH CHAIR APPARATUS

(75) Inventor: Mark A Flannery, Lakeville, MN (US)

(73) Assignee: Regalo International, LLC, Prior Lake, MN (US)

( * ) Notice: Subject to any disclaimer, the term of this patent is extended or adjusted under 35 U.S.C. 154(b) by 0 days.

(21) Appl. No.: 12/151,093

(22) Filed: Apr. 30, 2008

(51) Int. Cl.
*A47D 1/10* (2006.01)
*A47D 1/08* (2006.01)
*A47C 3/02* (2006.01)

(52) U.S. Cl. ..... 297/134; 297/174 CS; 297/133; 297/271.6

(58) Field of Classification Search ..... 297/174 CS, 297/174 R, 271.6, 271.5, 272.1, 258.1, 133, 297/131, 134, 451.3, 447.2
See application file for complete search history.

(56) References Cited

U.S. PATENT DOCUMENTS

| | | | | |
|---|---|---|---|---|
| 887,529 | A | | 5/1908 | Schnee |
| 1,501,443 | A | | 7/1924 | Ellis |
| 1,525,011 | A | | 2/1925 | Stoltz |
| 1,606,541 | A | | 11/1926 | Straith |
| 2,451,667 | A | | 10/1948 | Ducey |
| 2,493,187 | A | | 1/1950 | Ducey |
| D181,700 | S | | 12/1957 | Armitage |
| 2,821,241 | A | | 1/1958 | Schwahn |
| 2,845,995 | A | | 8/1958 | Landry |
| 2,956,617 | A | | 10/1960 | Bruderer |
| 3,021,185 | A | | 2/1962 | Kowalczyk |
| 3,133,760 | A | | 5/1964 | Robinson |
| 3,160,437 | A | | 12/1964 | Hill |
| 3,977,722 | A | | 8/1976 | Gist |
| 4,014,592 | A | | 3/1977 | Gist |
| 4,506,928 | A | | 3/1985 | Marion |
| 4,530,539 | A | | 7/1985 | Gaber et al. |
| 4,629,247 | A | | 12/1986 | Wu |
| 4,863,216 | A | | 9/1989 | Prescott |
| 5,178,438 | A | | 1/1993 | Beger |
| 5,329,865 | A | | 7/1994 | McWard |
| 5,411,315 | A | | 5/1995 | Greenwood |
| 5,498,054 | A | | 3/1996 | Tomlinson |
| 5,531,159 | A | | 7/1996 | Stubblefield |
| 5,626,394 | A | | 5/1997 | Perry |
| 5,678,890 | A | * | 10/1997 | Tenbroeck ..... 297/271.6 |
| 5,921,621 | A | | 7/1999 | Cook et al. |
| 6,053,117 | A | | 4/2000 | Daoud |
| 6,435,186 | B1 | | 8/2002 | Klemm |
| D481,209 | S | | 10/2003 | Chen |
| 6,679,549 | B2 | | 1/2004 | Catelli |
| 6,736,451 | B1 | | 5/2004 | Chen |
| 7,021,719 | B2 | | 4/2006 | Stoll |
| 7,032,970 | B1 | | 4/2006 | Kharat |
| 7,156,465 | B2 | | 1/2007 | Stewart et al. |
| 2003/0062757 | A1 | | 4/2003 | Calvery |
| 2007/0040430 | A1 | | 2/2007 | Flannery |
| 2008/0203780 | A1 | | 8/2008 | Anselmi et al. |
| 2008/0296938 | A1 | | 12/2008 | Flannery |

* cited by examiner

*Primary Examiner*—Milton Nelson, Jr.

(57) ABSTRACT

A child seat apparatus that may be engaged on the end of a table top so as to be used as a hook on high chair and that also may be set on the floor to be used as a rocker. The apparatus includes a base that includes longitudinal curved members. A rear portion of the base can be disengaged from the front portion of the base such that, when used as a hook on high chair, the rear portion can swing to an out-of-the-way position underneath front portion, so that the rear portion does not protrude into kitchen or dining room space.

15 Claims, 3 Drawing Sheets

ROCKER AND HOOK ON HIGH CHAIR APPARATUS

FIELD OF THE INVENTION

The present invention generally relates to child seats, particularly to rockers and hook on high chairs, and specifically to a rocker and hook on high chair apparatus.

BACKGROUND OF THE INVENTION

A conventional high chair is a chair that includes relatively long legs and an elevated seat. The child sits on the elevated seat. Sometimes the conventional high chair includes a tray. Sometimes, with no tray or with the tray detached, the conventional high chair is slid close to the table top.

A hook on high chair engages the table top of a table. The hook on high chair includes no legs that reach to the floor. The hook on high chair may have a system of clamps or other apparatus for engaging the table top of a table.

A rocker may be a crib or bed like apparatus having curved feet such that the bed like rocker may be hand rocked back and forth in a soothing fashion when the child is lying down. A rocker can also be a seat like apparatus in which the child sits or is reclined back instead of fully lying down as in a crib. The seat like rocker also includes curved feet, or curved legs, such that the seat like rocker may be hand rocked back and forth in a soothing fashion.

SUMMARY OF THE INVENTION

A feature of the present invention is the provision in a child seat apparatus, of structure that permits the apparatus to operate as a rocker.

Another feature of the present invention is the provision in a child seat apparatus, of structure that permits the apparatus to operate as a hook on high chair.

Another feature of the present invention is the provision in a rocker and hook on high chair apparatus, of a frame having a base, first and second inclined members extending upwardly and obliquely of the base, and upper and lower arms extending forwardly and obliquely of the inclined members to work in concert to engage a table top.

Another feature of the present invention is the provision in a rocker and hook on high chair apparatus, of five integral pieces that make up the entire frame of the apparatus and that snap together and apart such that the apparatus may be broken down to take up a minimum of shelf space or storage space.

Another feature of the present invention is the provision in a rocker and hook on high chair apparatus, of a first integral piece that provides at least a portion of the base of the apparatus, and of integral inclined extensions protruding from the first integral piece that serve as points of connection for a body of the apparatus such that strength and stability is maximized.

Another feature of the present invention is the provision in a rocker and hook on high chair apparatus, of an integral front base portion that has a right side integral inclined extension and a left side integral inclined extension, and of the inclined extensions providing strong and stable connections for pieces that contain the arms that hook on to a table.

Another feature of the present invention is the provision in a rocker and hook on high chair apparatus, of an integral back base portion that is removably swingable with an integral front base portion and that, when removed and swingable, can be swung down and up to a position adjacent to the integral front base portion.

Another feature of the present invention is the provision in a rocker and hook on high chair apparatus, of a closed rocking base where the base includes a left side rocking member, a right side rocking member, a front stop or front lateral member that ties together the front of the rocking members, and a back stop or back lateral member that ties together the back of the rocking members.

Another feature of the present invention is the provision in a rocker and hook on high chair apparatus, of arms that reach out to engage a table top where each of the arms is supported at only a proximal end and have a free distal end that engages the table such that each of the distal ends is free from each of the other distal ends.

Another feature of the present invention is the provision in a rocker and hook on high chair apparatus, of a front lower lateral member lying in a front vertical plane, of a back lower lateral member lying in a back vertical plane, and of a remaining portion of said frame lying between said front and back vertical planes to minimize overrocking of said apparatus.

Another feature of the present invention is the provision in a rocker and hook on high chair apparatus, of the rocking longitudinal members having a generally central location, of the inclined members engaging the rocking longitudinal members forwardly of the generally central location, and of the seat engaging the inclined members at a position over the central location.

An advantage of the present invention is the two-in-one arrangement provided by the apparatus. The apparatus may be utilized as a hook on high chair. The apparatus may also be utilized as a rocker.

Another advantage of the present invention is that it is safe, stable and strong. One feature contributing to this advantage is that the base is relatively wide from front to rear such that the frame is positioned between front and rear lateral members of the base. Another feature contributing to this advantage is that the inclined members begin as welded or integral portions of the base such that there is no pin connection or articulation at the intersection of the base and the inclined members. Another feature contributing to this advantage is the seat being engaged to the inclined members at a position generally over a central location of the rocking longitudinal members.

Another advantage of the present invention is that it takes up a minimum of shelf space or storage space when broken down. The rocker and hook on high chair apparatus is assembled from five separate pieces and may be readily disassembled back into the five separate pieces.

Another advantage of the present invention is that it is unobtrusive when used as a hook on high chair. The relatively long rocking base can be broken down into front and back portions and the back portion is swingable down and then up again to be fixed adjacent to and underneath of the front portion such that the relatively long back portion of the base does not protrude out into kitchen or dining room space.

Another advantage of the present invention is that it is adjustable in height. The inclined members, or body carrying the seat and having the arms that hook on to a table top, may be adjusted up and down to set the seat at varying heights relative to the base.

Another advantage of the present invention is that it is simple to assemble and simple to disassemble. Spring biased pins pop into and out frame connections.

Another advantage of the present invention is that it is inexpensive to manufacture and therefore inexpensive to the consumer. Minimal frame parts are included. Excessive frame parts are excluded.

Another advantage of the present invention is that it is aesthetically pleasing. For instance, the upper arm that reaches out to the table top includes a slight curve that leads into a slight curve of the shoe that grips the upper surface of the table top, and the lower arms run parallel to sections of the longitudinal members of the front base portion.

DETAILED DESCRIPTION

Figure 1:
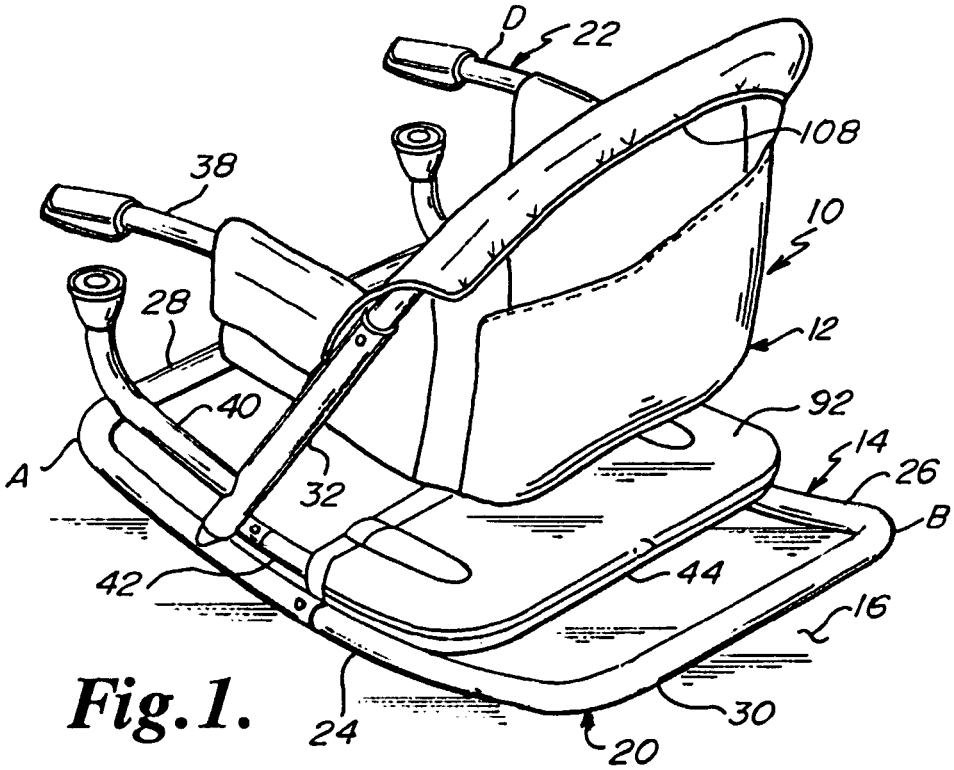
FIG. 1 is a rear perspective view of the present rocker and hook on high chair apparatus showing the apparatus in use as a rocker on a surface.
Figure 2:
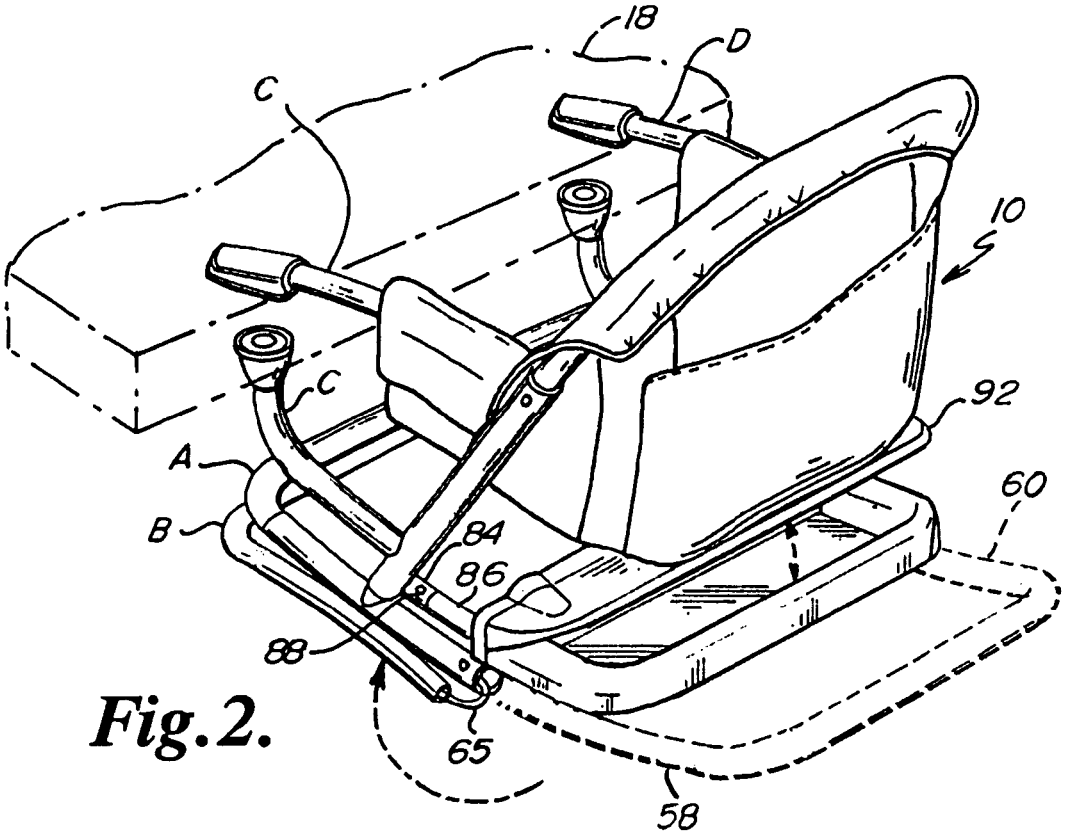
FIG. 2 is a rear perspective partially phantom view of the rocker and hook on high chair apparatus of FIG. 1, showing the arms of the apparatus engaging a table top and showing a back portion of the base swinging from a protruding position into an out-of-the-way position under the table top and adjacent to and underneath of a front portion of the base.

The present rocker and hook on high chair apparatus is indicated in FIG. 1 by reference numeral 10. The apparatus 10 includes a seat 12 and a frame 14 to which the seat 12 is engaged. The apparatus 10 may be used as a rocker for rocking on a surface 16, as shown in FIG. 1. The apparatus 10 may be used as a hook on high chair and engaged to a table top 18, as shown in FIG. 2.

Frame 14, preferably tubular, includes a base 20 and a body 22 engaged to the base 20 and extending upwardly and rearwardly therefrom. Base 20 includes a first longitudinal member 24, a second longitudinal member 26, a front lateral member 28 interconnecting the first and second longitudinal members 24 and 26 and supporting members 24 and 26 relative to each other, and a back lateral member 30 interconnecting the first and second longitudinal members 24 and 26 and supporting members 24 and 26 relative to each other. Body 22 includes a left side first inclined member 32, a right side second inclined member 34 opposite of member 32, an upper lateral member 36 interconnecting the first and second inclined members 32 and 34, a pair of upper arms 38, and a pair of lower arms 40. Body 22 further includes a pair of members 42 extending rearwardly from members 32, 34 for supporting a storage compartment 44. Members 32 and 34 extend upwardly and obliquely from their respective first and second longitudinal members 24 and 26. Upper arms 38 extends forwardly and obliquely of their respective first and second inclined members 32, 34. Lower arms 40 extend forwardly and obliquely of their respective first and second inclined members 32, 34.

With more specificity, base 20 includes a front base portion 46 and a back base portion 48. Portions 46, 48 are engaged via a male-female connection 50. A spring biased button 52 of back base portion 48 locks the portions 46, 48 to each other by engaging opening 53 formed in the front base portion 46. Spring biased button 52 and opening 53 provide for ready engagement and disengagement of the base portions 46 and 48. Front base portion 46 includes front lateral member 28, a front section 54 of first longitudinal member 24, and a front section 56 of second longitudinal member 26. Front lateral member 28, front section 54, and front section 56 are integral and one-piece with each other. This piece is referred to as the first integral piece A, which first integral piece A further includes a pair of lower inclined sections 57, each of which serves as a base for mounting one of the inclined members 32 and 34. Back base portion 48 includes back lateral member 30, a back section 58 of first longitudinal member 24, and a back section 60 of second longitudinal member 26. Back lateral member 30, back section 58 and back section 60 are integral and one-piece with each other. This piece is referred to as the second integral piece B.

Figure 3:
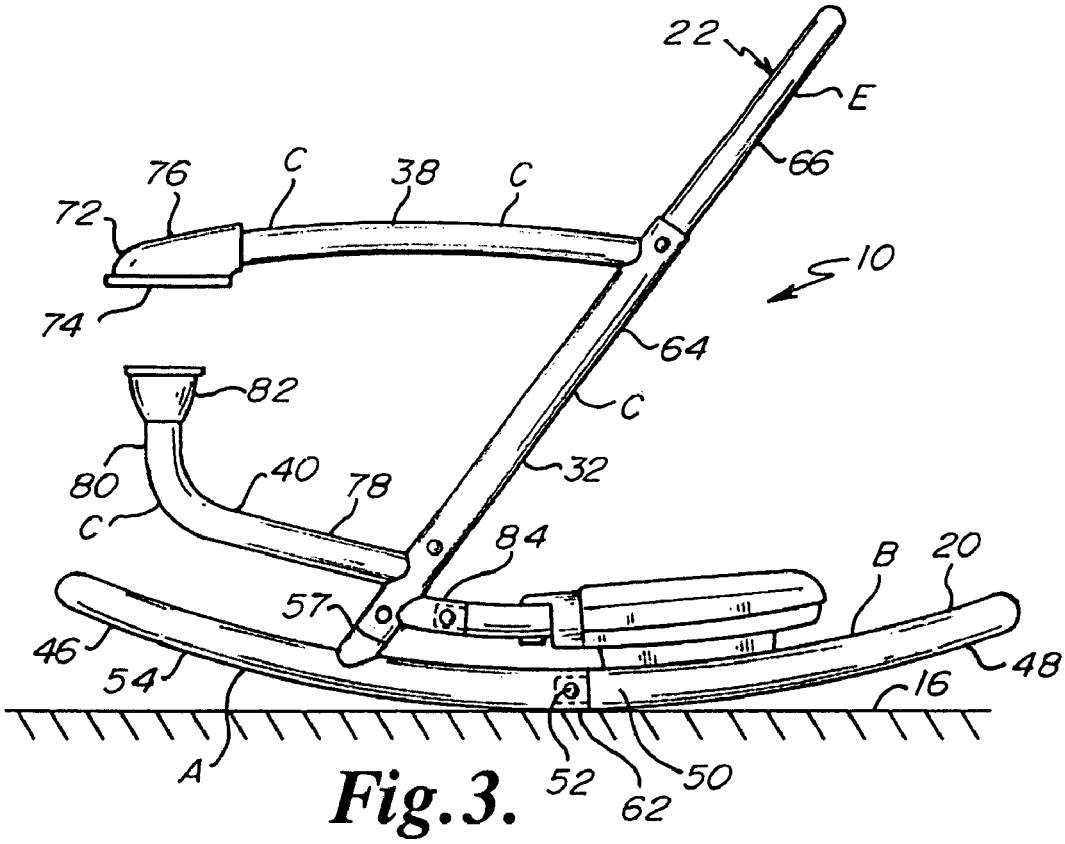
FIG. 3 is a side view of the rocker and hook on high chair apparatus of FIG. 1 where the apparatus is in use as a rocker.

Longitudinal members 24 and 26 run parallel to each other in a curving fashion so as to form a segment of an arc. As shown in FIG. 3, a central region 62 of each of the members 24, 26 makes contact with a surface on which the apparatus 10 rests. Forwardly of the central region 62, the longitudinal members 24 and 26 extend in a curvilinear fashion forwardly and upwardly. Rearwardly of the central region 62, the longitudinal members 24 and 26 extend in a curvilinear fashion rearwardly and upwardly. Front and back lateral members 28 and 30 act in the nature of stops to minimize overrocking of the apparatus 10. Seat 12 is engaged in frame 14 at a location on the body 22 that is disposed over the central region 62 so as to maximize stability. In other words, the front lower lateral member 28 lies in a front vertical plane, the back lower lateral member 30 lies in a back vertical plane, and the entire remainder of the frame 14 lies between such front and back vertical planes to minimize overrocking of the apparatus 10. In still other words, first and second inclined members 32 are engaged to the first and second longitudinal members 24 and 26 at positions forwardly of the central region or location 62 such that the seat 12 is located generally over the central location 62.

It should be noted that first longitudinal member 24, first inclined member 32, one of the upper arms 38, and one of the lower arms 40 are disposed in a first common plane. Likewise, second longitudinal member 26, second inclined member 34, the other of the upper arms 38, and the other of the lower arms 40 are disposed in a second common plane. First and second longitudinal rocking members 24, 26 run parallel to each other. First and second inclined members 32, 34, run parallel to each other. Upper arms 34 run parallel to each other. Lower arms 40 run parallel to each other. Front lateral member 28, back lateral member 30, and upper lateral member 36 run parallel to each other.

Figure 4:
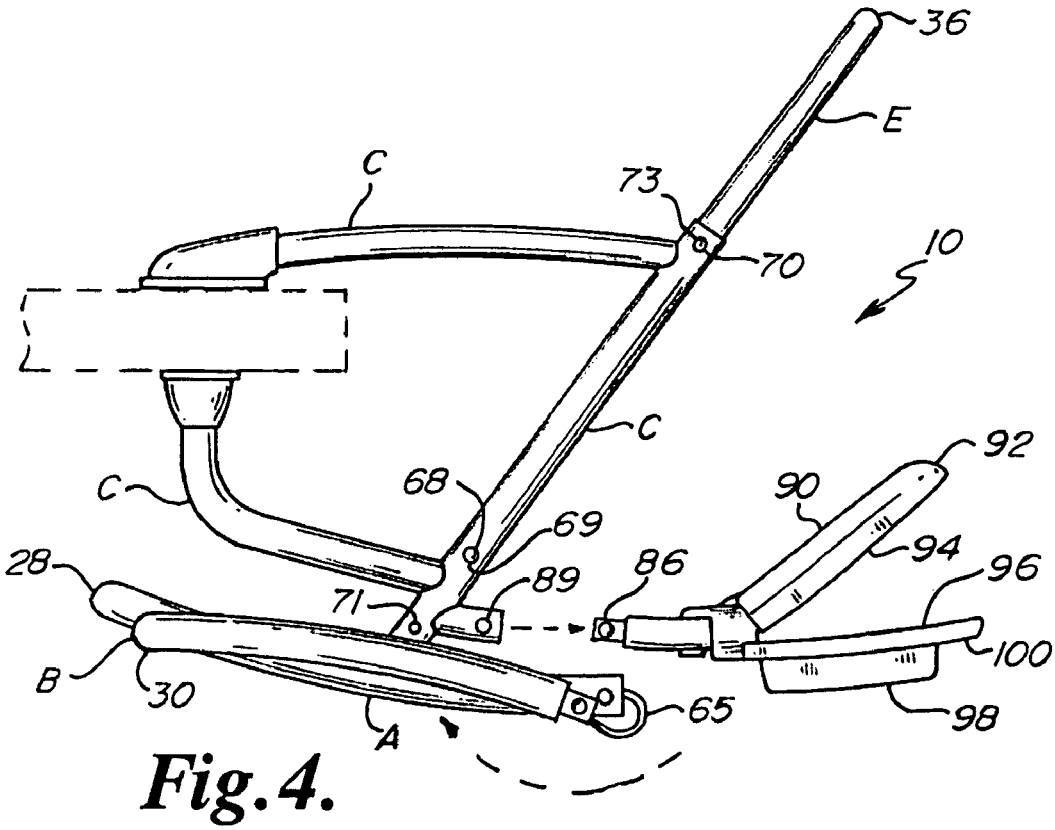
FIG. 4 is a side view of the rocker and hook on high chair apparatus of FIG. 2 where the apparatus is in use as a hook on high chair, and shows a removable storage compartment in a detached position.

A first flexible member or tether 65 such as a cord extends between paired front and back sections 54, 58. A second flexible member or tether 65 such as a cord extends between the other paired front and back sections 56, 60. One end of flexible member 65 is secured in one of the front sections and the other end is secured in the other of the back sections. Back sections 54, 58 and back lateral member 30, or the second integral piece B, or the back base portion 48, may thus be swung to an out-of-the-way position under the table top 18 where back lateral member 30 is adjacent to front lateral member 28. In such an out-of-the-way position, as shown in FIGS. 2 and 4, a third flexible member or strap 67 can be used to fix the back base portion 48, or the second integral piece B, under the front base portion 46, by securing the strap 67 to each of the front and back lateral members 28, 30. Strap 67 can be permanently engaged to one of the front and back lateral members 28 and can have opposing strap portions that engaged each other such as where one strap portion includes loops and the other of the strap portion includes hooks such as in VELCRO® material. The purpose of the flexible member 65 and strap 67 is at least twofold: 1) to keep the back base portion 48 handy and in a convenient location when the apparatus 10 is being used as a hook on high chair; and 2) to keep the back base portion 48 handy but in an out-of-the-way position when the apparatus 10 is being used as a hook on high chair.

Each of first and second inclined members 32, 34 includes base section 57, a medial inclined section 64, and an upper inclined section 66. Base section 57 and medial inclined section 64 are engaged with a male-female connection. Base section 57 includes a spring biased button 68 for locking and releasing the male-female connection by engaging one of an upper opening 69 and lower opening 71 formed in medial inclined section 64 such that the body 22 may be disposed at lesser and greater heights relative to the base 20. Medial inclined section 64 and upper inclined section 66 are engaged with a male-female connection. Upper inclined section 66 includes a spring biased button 70 for locking and releasing the male-female connection by engaging an opening 73 formed in the medial inclined section 64.

One of the medial inclined sections 64 is integral and one-piece with one of the upper arms 38 and one of the lower arms 40 and such integral piece is referred to as the third integral piece C. The other of the medial inclined sections 64 is integral and one-piece with the other of the upper arms 38 and the other of the lower arms 40 and such integral piece is referred to as the fourth integral piece D.

The upper inclined sections 66 are integral and one-piece with each other and the upper lateral member 36 which ties the upper inclined sections 66 together. Such, the integral and one-piece arrangement of one upper inclined section 66 extending integrally into the upper lateral member 36 which in turn extends integrally into the other of the upper inclined section 66, is referred to as the fifth integral piece E.

Upper arm 38 extends forwardly from an upper end portion of medial inclined section 64. Upper arm 38 includes a slight radius such that upper arm 38 is curved from a proximal end to a distal end. Upper arm 38 includes a central region along its length and, at such central region, a horizontal axis tangentially intersects a point in this central region. Upper arm 38 extends slightly upwardly from the proximal end, where it is engaged to the medial inclined section 64, to the central region. Upper arm 38 extends slightly downwardly from the central region to the distal end of the upper arm 38.

An upper shoe 72 is engaged to the distal end of the upper arm 38. At least a lower portion 74 of upper shoe 72 is formed of a resilient material so as not to mar a table top and so as to provide a give to the shoe 72. Preferably entire shoe 72 is formed of a resilient material. An upper surface 76 of shoe 72 runs parallel to an upper edge of upper arm 38 so as to provide an aesthetic appearance to the combination of the curved upper arm 38 and the curved upper shoe 72.

Lower arm 40 includes a proximal end tubular portion 78 and a distal end tubular portion 80. Proximal end portion 78 includes a proximal end that is engaged to medial inclined section 64. Distal end portion 80 includes a distal end that confronts a lower shoe 82. Proximal end portion 78 extends upwardly and forwardly from a lower end portion of medial inclined section 64 and, in such an upwardly and forwardly manner, proximal end portion 78 runs parallel in an aesthetic manner to front sections 54 of the first and second longitudinal members 24 and 26. Distal end portion 80 extends at an angle to proximal end portion 78 and runs generally vertically. Distal end portion 80 threadingly engages a shaft that in turn mounts the lower shoe 82. Turning or rotating the lower shoe 82 moves the lower shoe 82 up and down relative to the distal end portion 80 so as to engage and disengage the lower shoe relative to the lower surface of table top 18 and so as to oppose the upper shoe 72 that may be resiliently squeezed against the upper surface of the table top 18.

It should be noted that each of the upper arms 38 and each of the lower arms 40 includes a proximal end and that each of the arms 38, 40 is supported only at such proximal end where the proximal end engages the medial inclined section 64. It should further be noted that each of the upper arms 38 and each of the lower arms 40 includes a distal end and that each of such distal ends is free from each of the other distal ends. In other words, the distal ends of the arms 38, 40 derive no support from other arms or other distal ends of the arms 38, 40. Arms 38, 40 are in the nature of branches stemming from a tree and support themselves solely through the connection to the medial inclined section 64.

In the embodiment of FIGS. 1-4, upper and lower shoes 72 and 82 directly oppose each other. That is, from a side perspective, front and rear edges of lower shoe 82 are contained wholly within vertical planes intersecting the front and rear edges of upper shoe 72.

Member 42 extends rearwardly from inclined medial section 64 supporting the storage compartment 44. A section 84 of member 44 is integral and one-piece with medial section 64, upper arm 38 and lower arm 40. A left side section 86 of member 42 supports storage compartment 44 along with a right side section 86. Sections 84, 86 are engaged via a male-female connection and the connection may be locked and unlocked with a spring biased button 88 of section 86 that engages an opening 89 in section 84. Member 42 as a whole, including sections 84 and 86, run aesthetically parallel to first and second longitudinal members 24 and 26, including portions of front sections 54, 56 and back sections 58, 60. Compartment 44 includes features that run from front to back and that are slightly curved and that run parallel to portions of sections 54, 56, 58 and 60. These features include one or more of an upper surface 90 of a lid 92, a lower surface 94 of the lid 92, an upper surface 96 of a receptacle 98, and a lower surface of a lip 100 of the receptacle 98. The lid 92 is hinged to the receptacle 98. The width of the receptacle 98 can be less than the distance between inner edges of the longitudinal members 24 and 26 such that the depth of the receptacle 98 can be increased so as to increase the storage area of the storage compartment 44.

Seat 12 includes a seat bottom 102, a seat back 104, and a pair of seat sides 106. Seat back 104 includes a back sleeve 108 for engaging the fifth integral piece E. In other words, back sleeve 108 engages upper lateral member 36 and at least a portion of each of the upper inclined sections 66. Seat side 106 is doubled back so as to form a side sleeve 110 for engagement of upper arm 38. To remove the seat 12 such as for washing, buttons 70 are operated to remove the fifth integral piece E from the third and fourth integral pieces C and D. Fifth integral piece E is then slid out of the sleeve 108. Then the seat 12 is slid forwardly such that sleeves 110 slide over and off the upper arms 38 and upper shoes 72.

Figure 5:
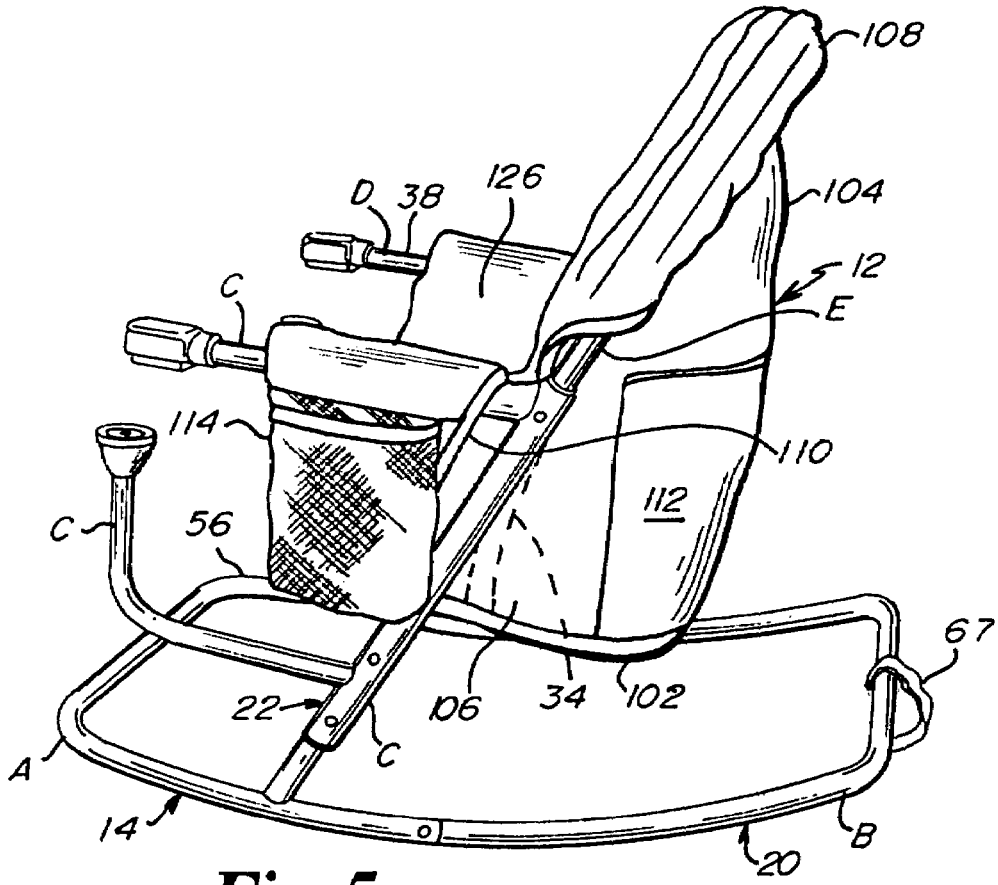
FIG. 5 is a side perspective partially phantom view of an alternate embodiment of the present rocker and hook on high chair apparatus.

Seat 12 includes a back pocket 112 running generally the width of the seat 12. Back pocket 112 includes an upper open end. Seat 12 may, if desired as shown in FIG. 5, further include a pair of side mesh pockets 114 engaged to respective side sleeves 110. Mesh pocket 114 includes an upper open end.

Seat 12 can further include a harness system 116 having one or more shoulder straps 118, one or more lap straps 120, an in-between-the-legs strap 122, and one or more buckles 124 interconnecting the various straps.

Seat 12 can further include a liner 126 having a seat bottom portion, a seat back portion, and seat side portions. Liner 126 lies on top of the seat bottom 102, on the inner front side of the seat back 104, and on the inner sides of the seat sides 106. Liner 126 is attached to an upper portion of the seat back 104 and an upper portion of the seat sides 106 with strips of hook and loop material such as VELCRO®.

Seat 12 preferably includes a rigid or semi-rigid sheet 128 enclosed in a double layered seat bottom 102 to lend rigidity to the seat bottom. The rigid or semi-rigid sheet 128 runs generally from front to back of the seat bottom 102 and from side to side of the seat bottom 102.

In operation, to assemble the apparatus 10, where the first and second integral pieces A and B have been pre-assembled in that the flexible member 65 has already been secured in the tube open ends, the first and second integral pieces A and B are connected by pushing in buttons 52 and by sliding the tube ends of the male-female connection 50 together. Then the third and fourth integral pieces C and D are connected via buttons 68 and a male-female connection to the first integral piece A. Then the side sleeves 110 of the seat 12 are slid over the upper shoes 72 and onto the upper arms 38. Then the fifth integral piece E is slid into the back sleeve 108. Then the fifth integral piece E is connected to the third and fourth integral pieces C and D by pushing in buttons 70 and sliding the respective tube ends together of the respective male-female connection.

To operate the apparatus 10 as a rocker, a child may be set into the seat 12 and secured therein with the harness system 116. Then the child and apparatus 10 may be rocked back and forth via the curved longitudinal members 24, 26. When used as a rocker, first and second integral pieces A and B are rigidly engaged to each other with the male-female connection 50.

To operate the apparatus 10 as a hook on high chair, a child, if present in seat 12, is removed. Then lower shoes 82 may be turned or rotated down so as to increase a distance between lower shoes 82 and upper shoes 72. Then the apparatus 10 may be lifted and slid onto the table top 18 such that the upper shoes 72 confront the upper surface of the table top 18 and such that the lower shoes 82 confront the lower surface of the table top 18. Then the lower shoes 82 are turned so as to decrease the distance between lower shoes 82 and upper shoes 72 and clamp the shoes 72, 82 to the table top 82. The weight of the apparatus 10 also serves to increase the tightness of the connection to the table top 18 because, as a rear part of the apparatus 10 is drawn down by gravity, whether or not a child is present in the seat 12, the lower arms 40 dig ever more securely into the under surface of the table top 18. As lower shoes 82 are turned and tightened, resilient shoes 72 are squeezed, thereby applying a greater clamping power to the table top 18. Then second integral piece B may be disconnected from first integral piece A by pressing buttons 52. Then second integral piece B is swung to the out-of-the-way position shown in FIG. 4 where the back lateral member 30 is adjacent to the front lateral member 28. Then strap 67, permanently fixed to back lateral member 30, is wrapped or looped about front lateral member 28 and then fixed back to itself to keep the second integral piece B in the out-of-the-way position. Then, with the apparatus 10 secured to the table top 18 and the second integral piece B tucked away, a caretaker may stand safely close to the apparatus 10 and thereby safely lift the child up and into the seat 12 where the harness apparatus 116 can be buckled about the child. After dinner, the child is taken out of the apparatus 10. Then the apparatus 10 may stay engaged to the table top 18, since the second integral piece B is not protruding into kitchen space. Or the apparatus 10 may be removed from the table top by loosening the lower shoes 82 and sliding the apparatus 10 off the table top, with or without the second integral piece B back in a rocking position rigidly fixed to first integral piece A.

Figure 6:
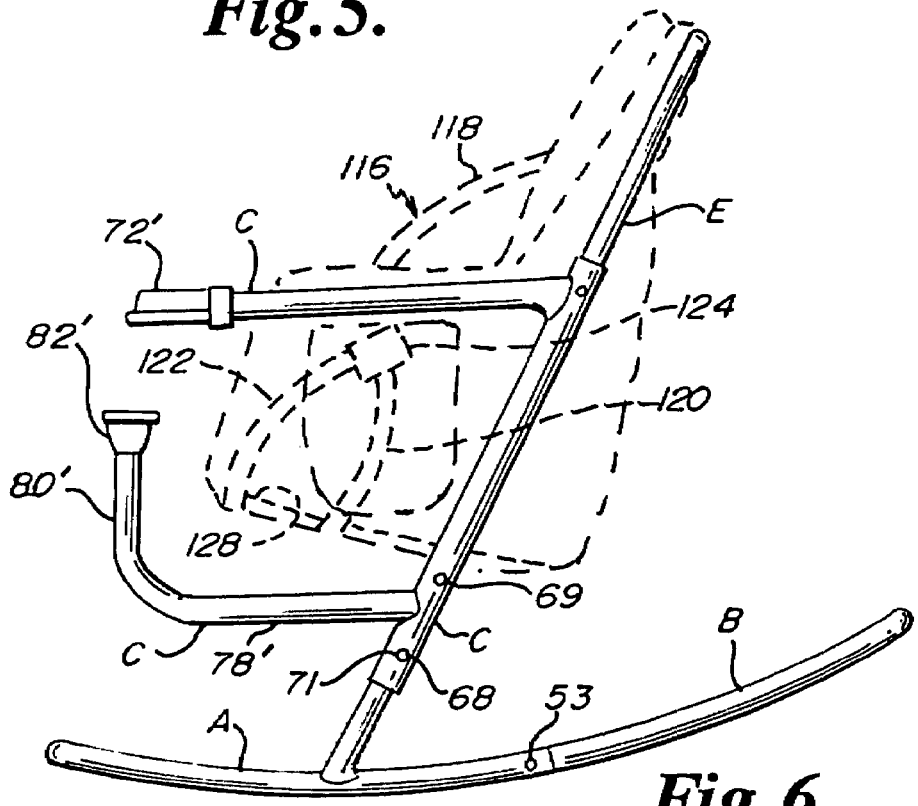
FIG. 6 is a side view of the rocker and hook on high chair apparatus of FIG. 5 and shows the seat of the apparatus in phantom.

In the alternate embodiment of FIGS. 5-6, upper and lower shoes 72' and 82' oppose each other. However, only a portion of the upper shoe 72' directly opposes a portion of the lower shoe 82'. A central region of lower shoe 82' is disposed slightly forwardly of a central region of upper shoe 82'.

In the preferred embodiment of FIGS. 1-4, it should be noted that the body 22 is set relatively low or relatively close to the base 20, utilizing an engagement between button 68 and upper opening 69. In the alternate embodiment of FIGS. 5-6, it should be noted that body 22 is set relatively high or at a greater distance from base 20, utilizing an engagement between button 68 and lower opening 71.

In the alternate embodiment of FIGS. 5-6, it should be noted that proximal end portion 78' runs parallel to upper arm 38 and that proximal end portion 78' and distal end portion 80' are set at generally a right angle to each other.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A rocker and hook on high chair apparatus, comprising:

a) a seat; and b) a frame to which the seat is engaged, wherein the frame comprises:

i) a base, with the base including first and second longitudinal members and front and back lower lateral members, with the lateral members extending to and between the longitudinal members so as to support the longitudinal members relative to each other, with at least a portion of each of the longitudinal members being curved such that the longitudinal members can rock back and forth upon a surface;

ii) a first inclined member extending upwardly and obliquely from the first longitudinal member and a second inclined member extending upwardly and obliquely from the second longitudinal member;

iii) an upper lateral member extending to and between the first and second inclined members so as to support the first and second inclined members relative to each other;

iv) a first upper arm engaged to and extending forwardly and obliquely of the first inclined member and a second upper arm engaged to and extending forwardly and obliquely of the second inclined member, with each of the first and second upper arms including a distal end;

v) a first upper foot engaged to the distal end of the first upper arm and a second upper foot engaged to the distal end of the second upper arm;

vi) a first lower arm engaged to and extending forwardly and obliquely of the first inclined member at a position lower than the first upper arm and a second lower arm engaged to and extending forwardly and obliquely of the second inclined member at a position lower than the second upper arm, with each of said first and second lower arms including a generally vertical frame section having a distal end; and vii) a first lower foot threadably engaged to the distal end of the generally vertical frame section of said first lower arm and a second lower foot threadably engaged to the distal end of the generally vertical frame section of said second lower arm such that said lower foot can be turned to and away from said distal end of said lower arm and thereby be turned to and away from a respective upper foot to engage a table top therebetween.

2. The rocker and hook on high chair apparatus according to claim 1, wherein said base includes first and second base portions readily engageable and disengageable from each other, with the first base portion including a section of the first longitudinal member, a section of the second longitudinal member, and said front lower lateral member, with the second base portion including a remaining section of the first longitudinal member, a remaining section of the second longitudinal member, and said back lower lateral member whereby, when the first and second base portions are engaged to each other, said apparatus can be used as one of a rocker and hook on high chair, and whereby, when the first and second base portions are disengaged from each other, said apparatus can be used as a hook on high chair and said second base portion can be swung to an out-of-the-way position under the first base portion.

3. The rocker and hook on high chair apparatus according to claim 2, and further comprising a first flexible member interconnecting said sections of the first longitudinal member and a second flexible member interconnecting said sections of the second longitudinal member.

4. The rocker and hook on high chair apparatus according to claim 3, and further comprising a third flexible member engaged to one of the first and second base portions and being engageable to the other of the first and second base portions such that said second base portion may be fixed in the out-of-the-way position under the first base portion.

5. The rocker and hook on high chair apparatus according to claim 1, wherein each of said inclined members comprises:

a first inclined section being integral with one of said longitudinal members;

a second inclined section readily engageable to and disengageable from the first inclined section, with said second inclined section being integral with one of said upper arms, with said second inclined section further being integral with one of said lower arms; and a third inclined section readily engageable to and disengageable from said second inclined section, with the third inclined sections being integral with each other via the upper lateral member.

6. The rocker and hook on high chair apparatus according to claim 1, wherein said frame comprises:

a) a first integral piece, with the first integral piece including a front section of the first longitudinal member, a front section of the second longitudinal member, the front lower lateral member, a lower section of the first inclined member, and a lower section of the second inclined member;

b) a second integral piece, with the second integral piece including a back section of the first longitudinal member, a back section of the second longitudinal member, and the back lower lateral member;

c) a third integral piece, with the third integral piece including a medial section of the first inclined member, the first upper arm and the first lower arm;

d) a fourth integral piece, with the fourth integral piece including a medial section of the second inclined member, the second upper arm and the second lower arm; and e) a fifth integral piece, with the fifth integral piece including an upper section of the first inclined member, an upper section of the second inclined member, and said upper lateral member.

7. The rocker and hook on high chair apparatus according to claim 6, wherein said second integral piece is engageable to and disengageable from said first integral piece, wherein said third integral piece is engageable to and disengageable from said first integral piece, wherein said fourth integral piece is engageable to and disengageable from said first integral piece, and wherein said fifth integral piece is engageable to and disengageable from the third and fourth integral pieces.

8. The rocker and hook on high chair apparatus according to claim 1, wherein each of said first and second inclined members is adjustable in height relative to said base.

9. The rocker and hook on high chair apparatus according to claim 1, wherein each of the first and second upper arms and each of the first and second lower arms includes a proximal end engaging one of the first and second inclined members, wherein each of said arms is supported only at said proximal end, and wherein each of the distal ends of said arms are free from each of said other distal ends.

10. The rocker and hook on high chair apparatus according to claim 1, wherein said front lower lateral member lies in a front vertical plane, wherein said back lower lateral member lies in a back vertical plane, and wherein a remaining portion of said frame lies between said front and back vertical planes to minimize overrocking of said apparatus.

11. The rocker and hook on high chair apparatus according to claim 1, wherein each of said first and second longitudinal members includes a central location, and wherein said first and second inclined members are engaged to the first and second longitudinal members at positions forwardly of said central location such that said seat is located generally over said central location.

12. A rocker and hook on high chair apparatus, comprising:

a) a seat; and b) a frame to which the seat is engaged, wherein the frame comprises:

i) a base comprising first and second longitudinal members, with at least a portion of each of the longitudinal members being curved such that the longitudinal members can rock back and forth upon a surface;

ii) a first inclined member extending upwardly and obliquely from the first longitudinal member and a second inclined member extending upwardly and obliquely from the second longitudinal member;

iii) an upper lateral member extending to and between the first and second inclined members so as to support the first and second inclined members relative to each other;

iv) a first upper arm engaged to and extending forwardly of the first inclined member and a second upper arm engaged to and extending forwardly of the second inclined member, with each of the first and second upper arms including a distal end;

v) a first lower arm engaged to and extending forwardly of the first inclined member at a position lower than the first upper arm and a second lower arm engaged to and extending forwardly of the second inclined member at a position lower than the second upper arm, with each of said lower arms including a distal end, and with the distal ends of the upper arms at least partially opposing the distal ends of the lower arms to engage a table top therebetween; and vii) wherein said base includes first and second base portions readily engageable and disengageable from each other, whereby, when the first and second base portions are engaged to each other, said apparatus can be used as one of a rocker and hook on high chair, and whereby, when the first and second base portions are disengaged from each other, said apparatus can be used as a hook on high chair and said second base portion can be swung to an out-of-the-way position under the first base portion.

13. The rocker and hook on high chair apparatus according to claim 12, and further comprising first and second flexible members interconnecting said first and second base portions such that said first and second base portions remain tethered together when said second base portion is in said out-of-the-way position.

14. The rocker and hook on high chair apparatus according to claim 13, and further comprising a third flexible member engaged to one of the first and second base portions and being engageable to the other of the first and second base portions such that said second base portion may be fixed in the out-of-the-way position under the first base portion.

15. A rocker and hook on high chair apparatus comprising:

a) a seat; and b) a frame to which the seat is engaged, wherein the frame comprises:

i) a first integral piece, with the first integral piece including a front section of a first longitudinal member, a front section of a second longitudinal member with said front sections running parallel to each other, a front lower lateral member that extends to and between the front sections of the first and second longitudinal members, a left lower side section of a first inclined member with said left lower side section extending from the first longitudinal member, and a right lower side section of a second inclined member with said right lower side section extending from the second longitudinal member;

ii) a second integral piece, with the second integral piece including a back section of the first longitudinal member, a back section of the second longitudinal member with said back sections running parallel to each other, and a back lower lateral member that extends to and between the back sections of the first and second longitudinal members;

iii) a third integral piece, with the third integral piece including a medial right section of the first inclined member, a first upper right arm and a first lower right arm, with the first upper right arm and the first lower right arm engaged to and extending forwardly of the medial right section of the first inclined member;

iv) a fourth integral piece, with the fourth integral piece including a medial left section of the second inclined member, the second upper left arm and the second lower left arm with the second upper left arm and the second lower left arm engaged to and extending forwardly of the medial left section of the second inclined member;

v) a fifth integral piece, with the fifth integral piece including an upper section of the first inclined member, an upper section of the second inclined member, and an upper lateral member that extends to and between said upper sections; and vi) wherein said second integral piece is engageable to and disengageable from said first integral piece, wherein said third integral piece is engageable to and disengageable from said first integral piece, wherein said fourth integral piece is engageable to and disengageable from said first integral piece, and wherein said fifth integral piece is engageable to and disengageable from the third and fourth integral pieces.

* * * * *